US005423243A

United States Patent [19]

Yamashita et al.

[11] Patent Number: 5,423,243

[45] Date of Patent: Jun. 13, 1995

[54] PNEUMATIC CYLINDER WITH CUSHION MECHANISM

[75] Inventors: Yoshisuke Yamashita; Kunihisa Kaneko; Nobuhiro Fujiwara, all of Yawara, Japan

[73] Assignee: SMC Corporation, Tokyo, Japan

[21] Appl. No.: 291,029

[22] Filed: Aug. 16, 1994

[30] Foreign Application Priority Data

Sep. 2, 1993 [JP] Japan ..... 5-242073

[51] Int. Cl.[6] ..... F15B 15/22

[52] U.S. Cl. ..... 91/408; 91/451

[58] Field of Search ..... 91/26, 27, 28, 405, 91/406, 407, 408, 409, 451, 452; 92/85 B, 169.1

[56] References Cited

U.S. PATENT DOCUMENTS

| | | | |
|---|---|---|---|
| 2,783,742 | 3/1957 | Shafer | 91/452 |
| 2,949,096 | 8/1960 | Ottestad et al. | 91/408 |
| 3,196,753 | 7/1965 | Maurer | 91/26 |
| 3,727,518 | 4/1973 | Gooding | 91/26 |

*Primary Examiner*—F. Daniel Lopez

*Attorney, Agent, or Firm*—Oblon, Spivak, McClelland, Maier & Neustadt

[57] ABSTRACT

A relief valve 23 serving as cushion pressure adjusting means in a cushion mechanism is provided on a support member 4, and the support member 4 is rotatably mounted on covers 2 and 3 of a pneumatic cylinder in order to facilitate adjustment of relief pressure.

4 Claims, 5 Drawing Sheets

PNEUMATIC CYLINDER WITH CUSHION MECHANISM

BACKGROUND OF THE INVENTION

1. Field of the Invention

The present invention relates to a pneumatic cylinder provided with a cushion mechanism by braking and stopping a piston at stroke end.

2. Prior Art

In the past, a pneumatic cylinder has been known, which is provided with a cushion mechanism for braking and stopping a piston at stroke end. Such pneumatic cylinder generally comprises a cylinder tube, a pair of covers for blocking both ends of the cylinder tube, a piston reciprocally moving within the cylinder tube, a piston rod integrated with the piston, a supply and discharge port for supplying and discharging compressed air to and from cylinder chambers on both sides of the piston, and a relief valve for limiting flow rate of exhaust air discharged from the cylinder chambers through the supply and discharge port, whereby the piston is decelerated by operating the relief valve and limiting flow rate of exhaust air when the piston approaches stroke end and braking and stopping the piston at stroke end.

However, the conventional type pneumatic cylinder as described above is disadvantageous in that the relief valve is directly incorporated in the cover, and this leads to more complicated structure of the cover and to inconveniences in manufacture.

Also, the relief valve is designed in such manner that it is opened by pressure of exhaust air discharged from the cylinder chambers through the supply and discharge port and that the pressure/relief pressure) when opening can be adjusted. Since the relief valve is provided at a predetermined position on the cover, it is often difficult or even impossible to adjust relief pressure depending upon site and position of the pneumatic cylinder, and this also results in inconveniences and troubles in maintenance or parts replacement.

Further, because the relief valve is opened by exhaust pressure, it is very likely to be influenced by exhaust air flow or by pressure fluctuation of the exhaust air. As a result, opening or closing conditions are less stabilized and flow rate of exhaust air is fluctuated. This further leads to bounding of the piston while moving and to impairment of stable cushion effect.

SUMMARY OF THE INVENTION

It is an object of the present invention to provide a pneumatic cylinder with a cushion mechanism, whereby a relief valve serving as a cushion mechanism is arranged on a member different from a cover, said member is mounted on the cover so that its position can be adjusted freely to simplify arrangement of the cover and to ensure adjustment of relief pressure and to facilitate maintenance procedure.

It is another object of the present invention to provide a pneumatic cylinder with cushion mechanism, comprising a relief valve, which is .less likely to be influenced by exhaust air flow or pressure change in the exhaust air.

To attain the above objects, the pneumatic cylinder with cushion mechanism of the present invention comprises a cylinder tube, a pair of covers for blocking both ends of the cylinder tube, a piston reciprocally moving within said cylinder tube, a piston rod integrated with said piston and a supply and discharge port for supplying and discharging compressed air in the cylinder chambers on both sides of the piston, the piston is decelerated by limiting flow rate of exhaust air discharged from the cylinder chambers through the supply and discharge port when the piston approaches stroke end, the pneumatic cylinder is provided with a set of cushion mechanisms, and the piston is braked and stopped at stroke end, whereby said cushion mechanism is provided with a relief valve for freely adjusting relief pressure when opened by action of exhaust pressure from the cylinder chambers to restrictively pass the exhaust air to the supply and discharge port from said cylinder chambers, and said relief valve is arranged on a support member different from said cover, and said support member is rotatably arranged around axial line of the cylinder.

By such arrangement as described above, it is possible to rotate said support member around axial line of the cover depending upon site and position of the pneumatic cylinder and to adjust its direction, and to simplify adjustment of relief pressure or to facilitate maintenance procedure.

In an embodiment of the present invention, the relief valve comprises a valve seat provided in a relief passage connecting the cylinder chambers with the supply and discharge port, a valve member for opening and closing said valve seat, a pressure chamber for applying exhaust pressure on one end of said valve member, and relief pressure adjusting means for adjusting force to apply operating force in reverse direction to operating force by said exhaust pressure on the other end of the valve member, and said pressure chamber is independently arranged at a place different from said relief passage and is connected with said relief passage by a signal passage.

Therefore, the valve member is very unlikely to be influenced by flow or pressure change of exhaust air passing through the relief passage, and this ensures stable opening and closing operation of the relief valve and to achieve smooth braking of the piston.

To ensure more stable opening and closing operation of the relief valve, it is preferable to approximately equalize areas of pressure receiving surfaces facing to each other of said valve member except the portion directly facing to the pressure chamber so that operating force by pneumatic pressure applied on the valve member in opening and closing directions is limited to operating force generated by air pressure within said pressure chamber.

According to the preferred embodiment of the present invention, the support member with the relief valve mounted on it has a mounting hole to be engaged rotatably and airtightly with outer peripheral surface of the cover, two relief passages communicated with portions upstream and downstream of said valve seat are separately opened on inner peripheral surface of said mounting hole, two peripheral grooves independently communicated with said two relief passages are formed, and passages communicated with said cylinder chambers and said supply and discharge port are independently opened into said peripheral grooves.

DETAILED DESCRIPTION OF THE PREFERRED EMBODIMENTS

Figure 1:
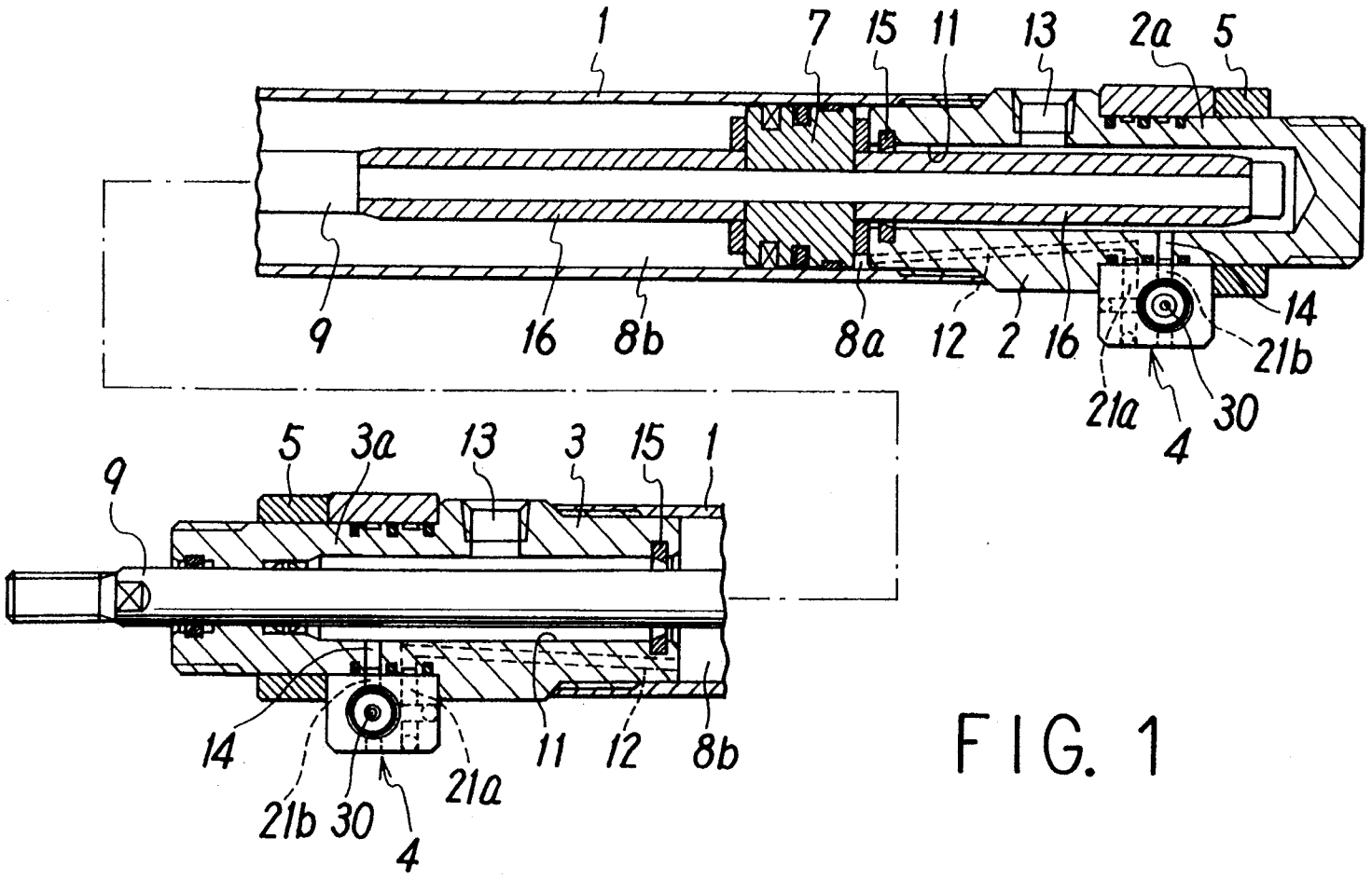
FIG. 1 is a partial cross-sectional view of an embodiment of a pneumatic cylinder according to the present invention except the middle portion.

FIG. 1 represents an embodiment of a pneumatic cylinder of the present invention, which comprises a cylinder tube 1, a head cover 2 and a rod cover 3 screwed on each end of the cylinder tube. On small diameter portions 2*a* and 3*a* of these covers, support members 4 each with a relief valve 23 are mounted by mounting members 5, and the relief valve constitutes a part of cushion mechanism.

The cylinder tube 1 is partitioned into cylinder chambers 8*a* and 8*b* by a piston 7, which reciprocally moves in the tube, and a rod 9 of the piston 7 is protruded out of the cylinder after airtightly penetrating the rod cover 3.

The covers 2 and 3 each comprises a recess 11 running in axial direction and opened to cylinder chambers 8*a* and 8*b* respectively, a cushion passage 12 with one end opened to the cylinder chambers 8*a* and 8*b* respectively and with the other end opened to outer peripheral surfaces of the small diameter portions 2*a* and 3*a*, a supply and discharge port 13 for compressed air and opened to the recess 11, and a passage 14 with one end opened to the recess 11 and the other end opened to outer peripheral surfaces of the small diameter portions 2*a* and 3*a*. The small diameter portions 2*a* and 3*a* of these passages 12 and 14 are opened into peripheral grooves in circumferential direction. A cushion packing 15 is mounted on inner peripheral surface of the opening of the recess 11, and cushion rings 16 and 16 closely engaged with the cushion packing 15 are mounted on each of the rods 9 on both sides of the piston 7.

Figure 2:
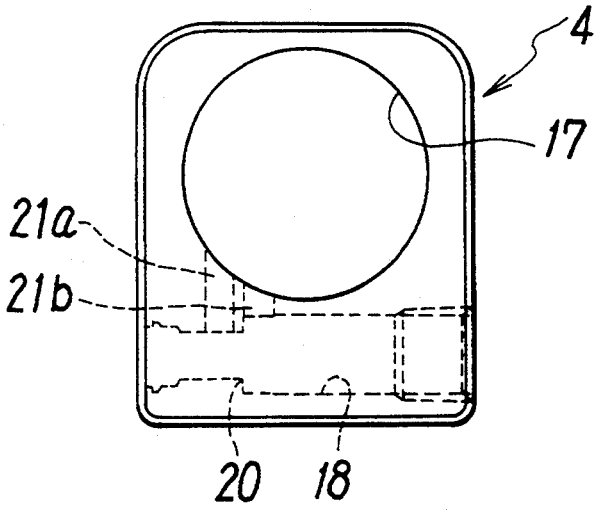
FIG. 2 is a side view of a support member with a relief valve mounted on it.
Figure 3:
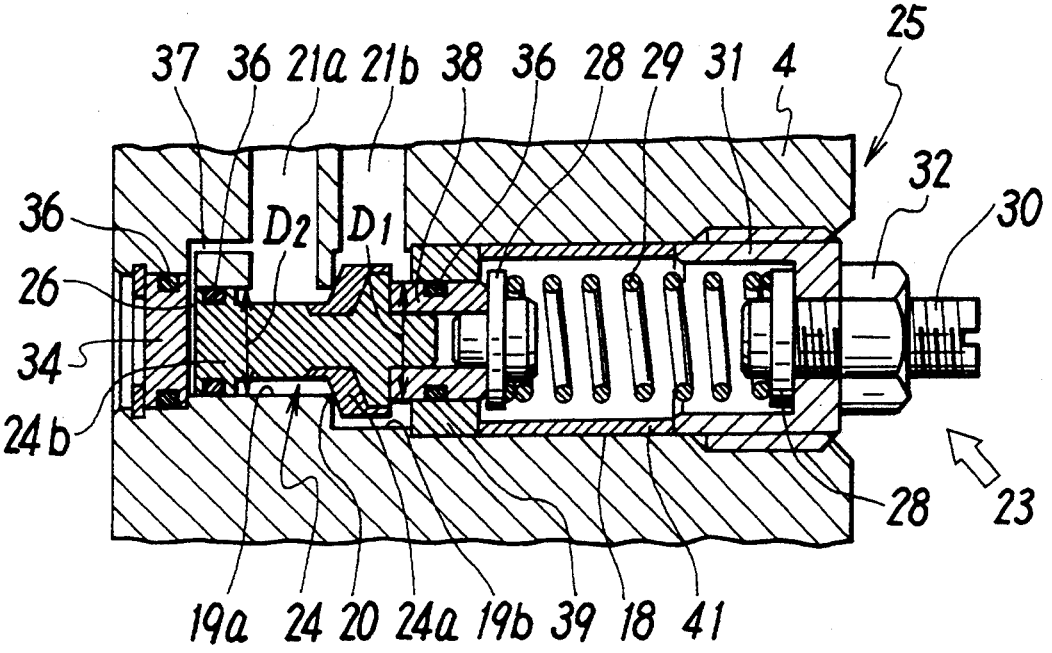
FIG. 3 is an enlarged cross-sectional view of an essential part of FIG. 2.

As shown in FIG. 2 and FIG. 3 in detail, the support member 4 comprises a mounting hole 17 airtightly and. rotatably engaged with the small diameter portions 2*a* and 3*a* of the covers 2 and 3, and a valve mounting hole 18 formed in perpendicular direction to the mounting hole 17. There are provided two valve chambers 19*a* and 19*b* with different cross-sectional areas and a valve seat 20 positioned between these valve chambers. The valve chamber 19*a* is communicated with the cushion passage 12 via a relief passage 21*a* upstream of the valve seat 20, and the valve chamber 19*b* is communicated with a passage 14 via a relief passage 21*b* downstream of the valve seat 20.

A relief valve 23 mounted on the valve mounting hole 18 constitutes cushion pressure adjusting means in a cushion mechanism and it comprises a valve member 24 for opening and closing the valve seat 20, a relief pressure adjusting mechanism 25 for pushing the valve member 24 in such direction that a valve sealing unit 24*a* closes the valve seat 20, and a pressure chamber 26 for applying pneumatic pressure on a piston unit 24*b* of the valve member 24 and for pushing the valve member 24 in a direction to open the valve seat 20.

The relief pressure adjusting mechanism 25 comprises a pair of spring receptacles 28 and 28, a pressure adjusting spring 29 being compressively mounted between these spring receptacles and pushing the valve member 24 in a direction to close the valve seat 20, and an adjusting screw 30 for adjusting pushing force of the pressure adjusting spring 29. The adjusting screw 30 is movably engaged with a valve guide 31 screwed on one end of the valve mounting hole 18 and is fixed at a predetermined position by a lock nut 32. Therefore, by moving the adjusting screw 30 back and forth with respect to the valve guide 31 and by adjusting pushing force of the pressure adjusting spring 29, relief pressure of the relief valve 23 can be adjusted, and cushion pressure can also be adjusted by adjusting the relief pressure.

Because the pressure chamber 26 is independently provided at a position away from the relief passage 21, it is kept out of influence of flow of the air passing through the relief passage 21*a* and of pressure fluctuation of the air. The pressure chamber 26 is arranged between an O-ring receptacle 34 fixed by retaining ring and a piston unit 24*b* of the valve member 24 on one end opposite to the side where the relief pressure adjusting mechanism 25 is mounted on the valve mounting hole 18, and both sides of the pressure chamber in axial direction are airtightly sealed by outer periphery of the piston unit 24*b* of the valve member 24 and by O-rings 36 and 36 mounted on O-ring receptacle 34, and it is communicated with the relief passage 21*a* via an air pressure signal passage 37 provided on the support member 4.

On one end of the valve member 24 closer to the valve chamber 19*b*, a stem 38 slidably engaged in a partitioning member 39 via the O-ring 36 is integrally mounted. By approximately equalizing outer diameter D1 of the stem 38 with inner diameter D2 of the valve chamber 19*a*, areas of the pressure receiving surfaces facing to each other in the valve member 24 except outer end surface of the piston unit 24*b* are approximately equalized so that operating force by air pressure applied on the valve member 24 in opening and closing directions is limited only to the operating force by air pressure in the pressure chamber 26. As a result, the valve member 24 can be opened or closed only by the operating force of air pressure in the pressure chamber 26 and the pressure adjusting spring 29, and this stabilizes the opening and closing operation. According to experimental data, when outer diameter D1 of the stem 38 is designed slightly larger than the inner diameter D2 of the valve chamber 19*a*, opening and closing behavior of the valve member 24 is more stabilized.

Reference numeral 41 in FIG. 3 represents a collar arranged between the valve guide 31 and the partitioning member 39. In the pneumatic cylinder of FIG. 1, the piston 7 reaches stroke end and is stopped after moving rightward. When it is stopped, the cushion mechanism acts as follows: When the piston 7 is moving rightward and the cushion ring 16 at right is not yet engaged with the cushion packing 15, the air in the cylinder chamber 8*a* is discharged from the supply and discharge port 13 via the recess 11 of the head cover 2.

When the piston 7 approaches stroke end and the cushion ring 16 is engaged with the cushion packing 15, the recess 11 is shut off from the cylinder chamber 8*a*. Thus, exhaust air in the cylinder chamber 8*a* is temporarily sealed in, and this decelerates the movement of the piston 7.

The exhaust air thus sealed flows into the pressure chamber 26 from the cushion passage 12 via the relief passage 21*a* and the air pressure signal passage 37 as it is evident from FIG. 3. It exerts action on the piston unit 24*b* of the valve member 24 and pushes the valve member 24 rightward in FIG. 3 against pushing force of the pressure adjusting spring 29. As a result, the valve member 24 opens the valve seat 29 in such degree that the force by the exhaust air pressure and pushing force of the pressure adjusting spring 29 keep balance. The exhaust air in the relief passage 21*a* is gradually discharged from the supply and discharge port 13 via the relief passage 21*a* and the recess 11, and the flow rate is restricted according to the opening degree of the valve seat 20. As the exhaust air is discharged, the piston 7 advances gradually and reaches stroke end while it is braked and is stopped.

Since the pressure chamber 26 is independently formed away from the relief passage 21*a* and is connected to the relief passage 21 via the air pressure signal passage 37, the valve member 24 is kept out of the influence of flow and pressure fluctuation of the exhaust air flowing in the relief passage 21*a*. As a result, opening and closing operation of the relief valve 23 is stabilized, and smooth deceleration and stopping of the piston 7 are ensured.

Outer diameter D1 of the stem 38 in the valve member 24 is designed as approximately equal to inner diameter. D2 of the valve chamber 19*a*, and area of the pressure receiving surfaces facing rightward and area of the pressure receiving surface facing leftward of the portions of the valve member 24 except the piston unit 24*b* are designed equal to each other so that operating force by air pressure applied in opening and closing direction of the valve member 24 is limited to the operating force by air pressure within the pressure chamber 26. This ensures more stabilized opening and closing operation of the valve seat 20 by the valve member 24.

Figure 4:
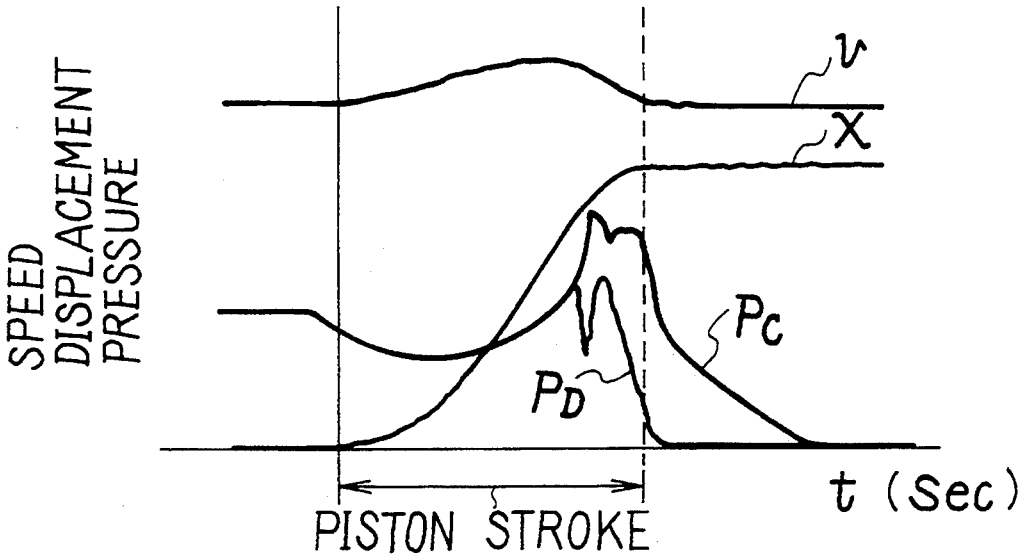
FIG. 4 is a diagram showing cushion performance of the pneumatic cylinder of the present invention.
Figure 5:
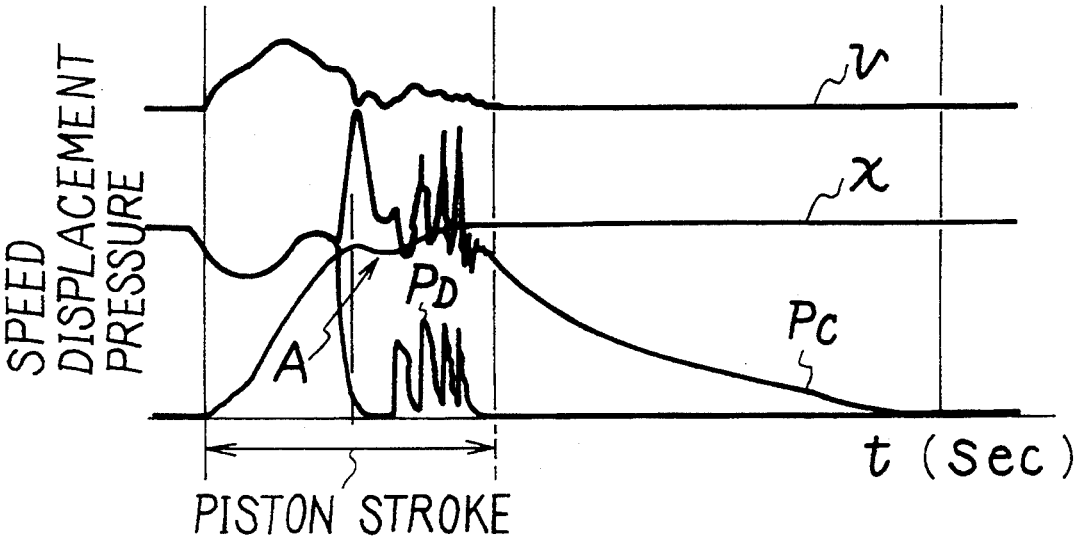
FIG. 5 is a diagram showing cushion performance of a conventional type pneumatic cylinder.

FIG. 4 and FIG. 5 each represents a diagram showing the results of experiments on cushion performance characteristics of the pneumatic cylinder of the present invention and a conventional type pneumatic cylinder. FIG. 4 represents cushion performance of the pneumatic cylinder of the present invention, and FIG. 5 shows that of the conventional type cylinder.

In these figures, reference symbol v represents moving speed of the piston, x is displacement of the cylinder, Pc is cushion air pressure upstream of the valve seat 20 (air pressure in the relief passage 21*a*), and PD represents air pressure in the relief passage 21*a* downstream of the valve seat 20.

As it is evident from these figures, there are higher fluctuation in cushion air pressure and bounding of piston (arrow A) associated with it, and smooth and stable cushioning effect cannot be expected. In contrast, according to the present invention, there are no inconveniences such as high fluctuation of cushion air pressure and bounding of the piston associated with it as inconventional type cylinder, and the piston can be smoothly and stably moved and can be stopped at stroke end.

In the pneumatic pressure cylinder in the above embodiment, the support member 4 with the relief valve 23 mounted on it is rotatably arranged on the covers 2 and 3, and the adjusting screw 30 of the relief valve 23 can be directed toward any direction around the cover. As a result, by adjusting its direction depending upon site and position of the pneumatic cylinder, it is possible to simplify adjustment of relief pressure and facilitate maintenance procedure. In this case, peripheral grooves are formed on the portion where the cushion passage 12 and the passage 14 on outer peripheral surface of the covers 2 and 3 are opened, and the relief passages 21*a* and 21*b* of the support member 4 are communicated with the peripheral grooves. Thus, even when the support member 4 is rotated, the cushion passage 12 and the relief passage 21*a* are always communicated with the relief passage 21*b* and the passage 14.

In case the piston 7 moves in reverse direction, the cushion mechanism provided on left side in FIG. 1 fulfills similar function.

The above cushion mechanism may be provided on either side.

Figure 6:
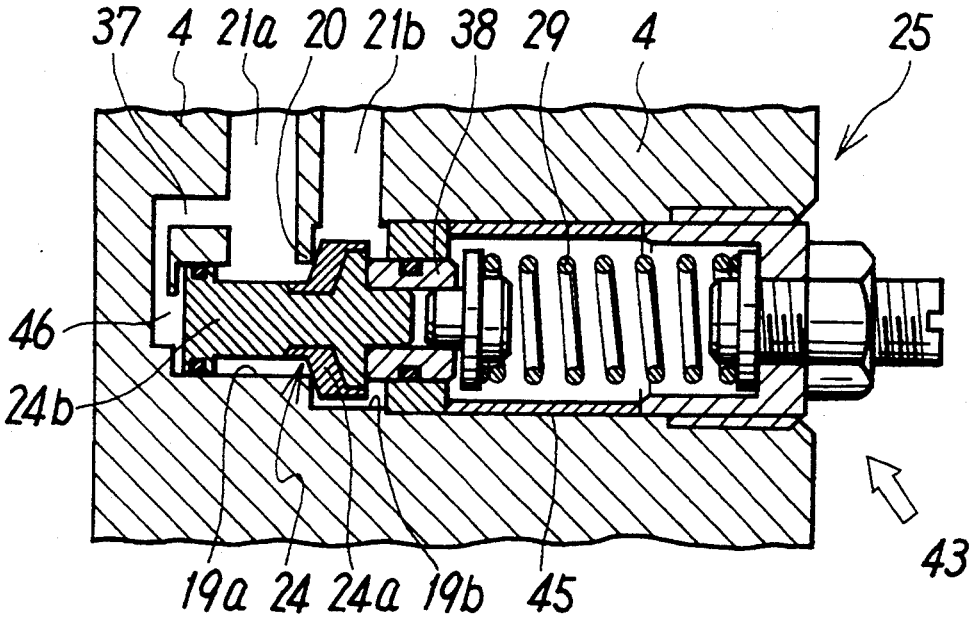
FIG. 6 represents a cross-sectional view of an essential part of a second embodiment of the relief valve.

FIG. 6 represents a second embodiment of the relief valve in the cushion mechanism. In this relief valve 43, the valve mounting hole 45 is designed as a bag hole not penetrating the support member 4, and a pressure chamber 46 is provided between bottom wall of the valve mounting hole 45 and the end of the valve member 24.

By designing the valve mounting hole 45 as a bag hole, it is possible to reduce the number of components since neither O-ring receptacle nor retaining ring for stopping O-ring receptacle is required, and it is also possible to increase safety because there is no danger that retaining ring is detached.

The other arrangement and action of the second embodiment are substantially the same as those of the first embodiment of FIG. 3. Accordingly, the same component is referred by the same symbol, and detailed description is not given here.

Figure 7:
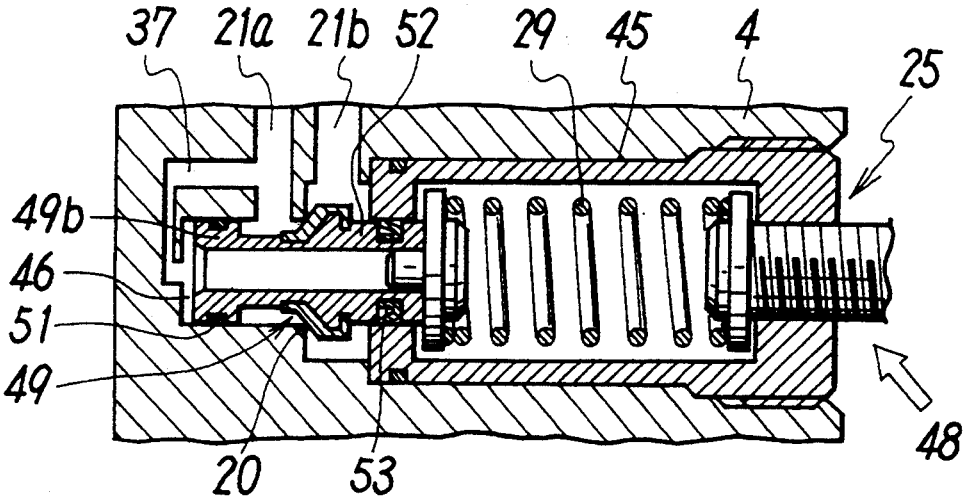
FIG. 7 is a cross-sectional view of an essential part of a third embodiment of the relief valve.
Figure 8:
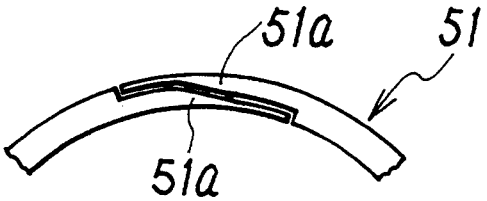
FIG. 8 is an enlarged front view of an essential part of a guide member used in FIG. 7.

FIG. 7 and FIG. 8 each represents a third embodiment of the relief valve of the cushion mechanism. On a valve member 49 of a relief valve 48, a ring-shaped wide guide member 51 made of synthetic resin is engaged on outer periphery of a piston unit 49b, and a lip seal 53 is attached on a stem 52. Both ends 51*a* and 51*a* of the guide member 51 are formed with such thin thickness that thickness will be approximately the same as the other intermediate portion when overlapped, and both ends of the overlapped portions are diagonally overlapped each other.

In the relief valve 48 of the third embodiment, more emphasis is placed on guiding function of the valve member 49 and reduction of friction rather than sealing function of the pressure chamber 46, and the valve member 49 is not tilted by the guide member 51 having wider width instead of O-ring, and is guided with less force. However, air leakage from the pressure chamber 46 to the valve chamber 19*a* can be minimized because the two ends of the guide member 51 are diagonally overlapped.

Also, because outer periphery of the stem 52 is sealed with the lip seal 53, sliding resistance of the valve member 49 can be reduced more compared with the sealing by O-ring.

The other arrangement and action of the relief valve 48 of the third embodiment are substantially the same as in the second embodiment. Accordingly, the same component is referred by the same symbol, and detailed description is not given here.

Figure 9:
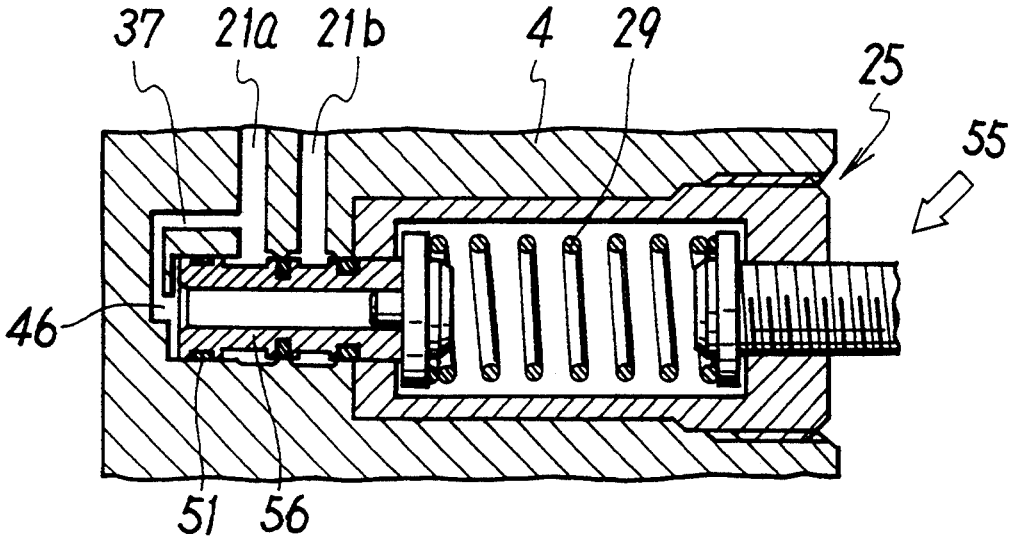
FIG. 9 is a cross-sectional view of an essential part of a fourth embodiment of the relief valve.

FIG. 9 shows a fourth embodiment of the relief valve in the cushion mechanism. The valve member 56 of the relief valve 55 is designed as a spool valve for shutting off communication between the relief passages 21*a* and 21*b*.

The other arrangement and action of the relief valve of the fourth embodiment are substantially the same as in the third embodiment. Accordingly, the same component as in the third embodiment is referred by the same symbol, and detailed description is not given here.

Figure 10:
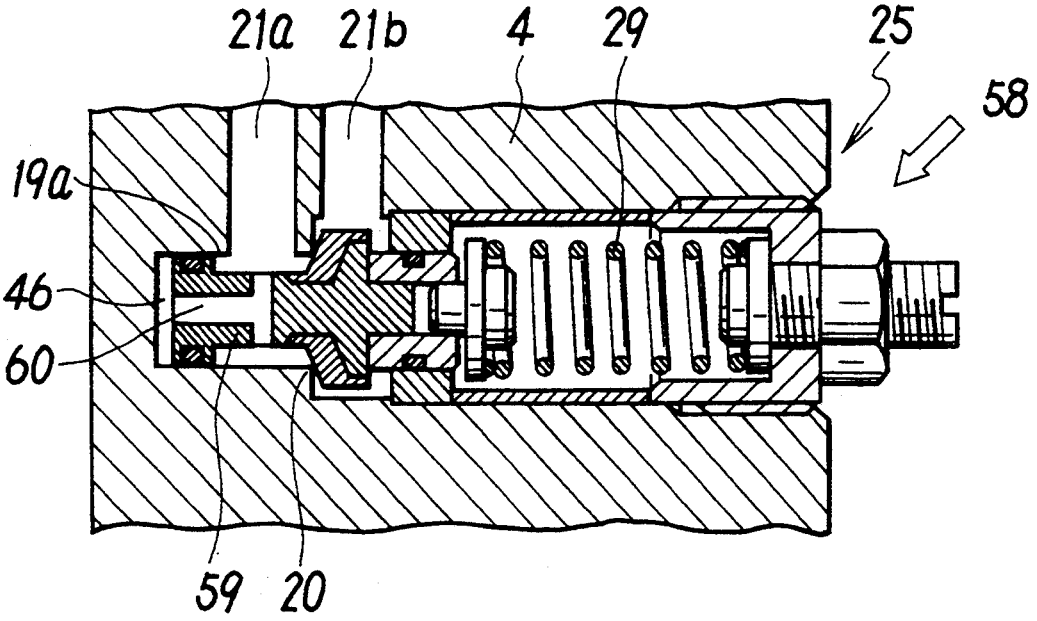
FIG. 10 is a cross-sectional view of an essential part of a fifth embodiment of the relief valve.

FIG. 10 represents a fifth embodiment of the relief valve in the cushion mechanism. In the relief valve 58 of this embodiment, the air pressure signal passage 60 for communicating the valve and the pressure chamber 46 is disposed on the valve member 59.

By providing the air pressure signal passage 60 on the valve member 59, it is easier to form.

The other arrangement and action of the relief valve of the fifth embodiment are substantially the same as the fourth embodiment. Thus, the same component as in the fourth embodiment is referred by the same symbol, and detailed description is not given here.

As described above, it is possible according to the pneumatic cylinder with cushion mechanism of the present invention to mount the relief valve in more easily adjustable direction depending upon site and position of the pneumatic cylinder because the relief valve serving as cushion pressure adjusting means in the cushion mechanism is provided on a support member independent from the cover, and the support member is rotatably mounted on the cover. As a result, it is possible to simplify adjustment of relief pressure and to facilitate maintenance regardless of the direction of the cylinder. Because there is no need to provide the relief valve on the cover, the design of the cover is simplified, and this leads to easier production.

Further, the valve member in the relief valve is kept out of influence of the flow and pressure fluctuation of exhaust air flowing in the relief passage. This results in stable opening and closing operation of the valve member and ensures smooth and stabilized cushioning effect. Thus, the piston can be stably stopped at stroke end.

What we claim is:

1. A pneumatic actuator with a cushion mechanism, comprising a pneumatic cylinder, in which there are provided a cylinder tube, a pair of covers for blocking both ends of the cylinder tube, a piston reciprocally moving within said cylinder tube, a piston rod integrated with said piston, and a supply and discharge port for supplying and discharging compressed air to and from cylinder chambers on both sides of the piston, and at least one cushion mechanisms, by which flow rate of exhaust air discharged from the cylinder chambers via the supply and discharge port is restricted when the piston approaches stroke end and the piston is decelerated and is further braked and stopped at stroke end, whereby:

the cushion mechanism is provided with a relief valve for adjusting relief pressure and opened by action of exhaust air pressure from the cylinder chamber and restrictively passing the exhaust air from the cylinder chambers to the supply and discharge port, said relief valve being mounted on a support member other than said cover, and said support member is rotatably mounted on the cover around axial line of the cylinder.

2. A pneumatic actuator with a cushion mechanism according to claim 1, wherein said relief valve comprises a valve seat disposed in a relief passage connecting the cylinder chambers with the supply and discharge port, a valve member for opening and closing said valve seat, a pressure chamber for applying exhaust air pressure on one end of the valve member, and relief pressure adjusting means for adjusting pushing force in order to apply operating force in reverse direction to the operating force by the exhaust air pressure on the other end of the valve member, whereby said pressure chamber is independently provided at a site separate from the relief passage, and is connected to said relief passage via a signal passage.

3. A pneumatic actuator with a cushion mechanism according to claim 2, wherein areas of the pressure receiving surfaces facing to each other of the valve member except the portion facing to the pressure chamber are made approximately equal to each other so that operating force by air pressure applied on the valve member in opening and closing directions is limited only to the operating force generated by air pressure in the pressure chamber.

4. Pneumatic actuator with a cushion mechanism according to claims 2 or 3, wherein said support member has a mounting hole, which is engaged airtightly and rotatably with outer peripheral surface of the cover, two relief passages communicated to upstream and downstream of said valve seat are independently opened on inner peripheral surface of the mounting hole, two peripheral grooves independently communicated with said two relief passages are formed on outer peripheral surface of the cover, and passages communicated with said cylinder chambers and said supply an discharge port are independently opened to said peripheral grooves.

* * * * *